US011441295B2

(12) United States Patent
Plouffe

(10) Patent No.: US 11,441,295 B2
(45) Date of Patent: Sep. 13, 2022

(54) SYSTEM AND METHOD FOR INDICATING TO AN OPERATOR A FORWARD DIRECTION OF TRAVEL OF A MACHINE

(71) Applicant: GJ MENARD INC., Lac Brome (CA)

(72) Inventor: Philippe Plouffe, Lac Brome (CA)

(73) Assignee: GJ MENARD INC., Lac Brome (CA)

( * ) Notice: Subject to any disclaimer, the term of this patent is extended or adjusted under 35 U.S.C. 154(b) by 107 days.

(21) Appl. No.: 16/626,990

(22) PCT Filed: Jun. 28, 2018

(86) PCT No.: PCT/IB2018/054829

§ 371 (c)(1),
(2) Date: Dec. 27, 2019

(87) PCT Pub. No.: WO2019/003191

PCT Pub. Date: Jan. 3, 2019

(65) Prior Publication Data

US 2020/0173146 A1 Jun. 4, 2020

Related U.S. Application Data

(60) Provisional application No. 62/526,026, filed on Jun. 28, 2017.

(51) Int. Cl.
*E02F 9/26* (2006.01)
*B66C 13/16* (2006.01)
(Continued)

(52) U.S. Cl.
CPC ..... *E02F 9/26* (2013.01); *B66C 13/16* (2013.01); *B66C 13/40* (2013.01); *B66C 13/46* (2013.01);
(Continued)

(58) Field of Classification Search
CPC . E02F 9/121; E02F 9/123; E02F 9/202; E02F 9/205; E02F 9/24; E02F 9/26;
(Continued)

(56) References Cited

U.S. PATENT DOCUMENTS 5,198,800 A * 3/1993 Tozawa ..... E02F 9/2033 212/276
5,742,069 A * 4/1998 Steenwyk ..... G01B 11/26 250/559.29
(Continued)

FOREIGN PATENT DOCUMENTS

CN 108349554 A 7/2018
JP S61106562 A 5/1986
(Continued)

OTHER PUBLICATIONS

International Search Report of PCT/IB2018/054829, dated Oct. 25, 2018, Authorized Officer: Christine Lord.

*Primary Examiner* — Tyler J Lee
(74) *Attorney, Agent, or Firm* — BCF LLP

(57) ABSTRACT

A system and method for indicating to an operator a forward direction of travel of a machine having a ground-engaging traveling device, a superstructure rotatably mounted to the traveling device and an operator station defining an operator point of view are provided. The system includes a system controller, a rotation-sensing system connected to the system controller for determining a rotational relationship of the superstructure with respect to the traveling device, and a singaler mounted to the operator station and connected to the system controller for indicating to the operator the forward direction of travel of the machine in accordance with the operator point of view. The method includes receiving a rotational relationship of the superstructure with respect to the traveling device, and indicating to the operator the
(Continued)

forward travel direction of the machine in accordance with the operator point of view.

18 Claims, 12 Drawing Sheets

(51) Int. Cl.

| | |
|---|---|
| ***B66C 13/40*** | (2006.01) |
| ***B66C 13/46*** | (2006.01) |
| ***B66C 15/06*** | (2006.01) |
| ***E02F 9/12*** | (2006.01) |
| ***E02F 9/20*** | (2006.01) |
| ***E02F 9/24*** | (2006.01) |

(52) U.S. Cl.
CPC ..... *B66C 15/065* (2013.01); *E02F 9/123* (2013.01); *E02F 9/202* (2013.01); *E02F 9/205* (2013.01); *E02F 9/24* (2013.01); *E02F 9/261* (2013.01)

(58) Field of Classification Search
CPC ..... E02F 9/261; B66C 13/16; B66C 13/40; B66C 13/46; B66C 13/54; B66C 15/065
See application file for complete search history.

(56) References Cited

U.S. PATENT DOCUMENTS

| | | | | |
|---|---|---|---|---|
| 7,772,969 | B2 * | 8/2010 | Prohaska | E02F 9/26 340/438 |
| 9,989,636 | B2 * | 6/2018 | Sherlock | G01S 13/931 |
| 2003/0230447 | A1 * | 12/2003 | Wulfert | B60R 11/02 180/329 |
| 2004/0211616 | A1 * | 10/2004 | Ueda | B66F 9/0759 180/326 |
| 2005/0027420 | A1 * | 2/2005 | Fujishima | E02F 9/2045 701/50 |
| 2005/0197756 | A1 * | 9/2005 | Taylor | E02F 3/847 701/50 |
| 2007/0010925 | A1 * | 1/2007 | Yokoyama | E02F 9/261 701/50 |
| 2009/0089703 | A1 | 4/2009 | Kim et al. | |
| 2017/0092093 | A1 * | 3/2017 | Dahbura | G08B 21/02 |

FOREIGN PATENT DOCUMENTS

| | | | |
|---|---|---|---|
| JP | 2001107398 | A1 | 4/2001 |
| JP | 2008214997 | A | 9/2008 |
| WO | 9118153 | A1 | 11/1991 |
| WO | 2016113466 | A1 | 7/2016 |

* cited by examiner

SYSTEM AND METHOD FOR INDICATING TO AN OPERATOR A FORWARD DIRECTION OF TRAVEL OF A MACHINE

CROSS-REFERENCE TO RELATED APPLICATION

The present application claims priority to U.S. Provisional Patent Application Ser. No. 62/526,026, filed Jun. 28, 2017, entitled "System and Method for Indicating to an operator a Forward Direction of Travel of a Machine", which is incorporated by reference herein in its entirety.

FIELD OF THE TECHNOLOGY

The present technology relates to a system and a method for indicating to an operator a forward direction of travel of a machine.

BACKGROUND

Certain construction machines such as excavators and cranes typically have an undercarriage including ground-engaging wheels or endless tracks for moving the machine, and a superstructure rotatably mounted to the undercarriage on which a work implement is mounted. An operator station (or cabin) is also mounted to the superstructure and allows an operator to have a point of view that follows the work implement.

The operator can operate the construction machine in various ways, such as moving the undercarriage on the ground forward or backward, rotating the superstructure and/or using the work implement. On many machines, the visibility offered by the operator station is poor and it can be challenging for the operator to easily identify what is the front and rear end of the undercarriage. In addition, when the superstructure is rotated repeatedly and the undercarriage is moved forward and backward repeatedly, the operator can become confused as to what is the forward travel direction of the machine and what gear of the gearbox is selected. As a result, the operator may unintentionally move the undercarriage in the wrong direction. Such unintentional operation of the machine can lead to incidents with nearby workers, loss of productivity, and machine wear as the machine is moved in one direction, suddenly stopped, and moved in the other direction. Moreover, such machines may be operated by inexperienced or distracted operators, and thus there are increased risks of wrong operation of the machine under such circumstances.

Therefore, there remains a need for minimizing risks of wrong operation of construction machines having an undercarriage and a rotatable superstructure mounted thereon.

SUMMARY

It is an object of the present technology to ameliorate at least some of the inconveniences present in the prior art.

According to one aspect of the present technology, there is provided a positional-relationship sensing system for indicating to an operator a forward direction of travel of a machine. The machine has a ground-engaging traveling device, and a superstructure rotatably mounted to the traveling device and having an operator station defining an operator point of view. The positional-relationship sensing system includes a system controller operatively connected to the machine. The positional-relationship sensing system further includes a rotation-sensing system operatively connected to the system controller. The rotation-sensing system includes a beacon and at least one sensor mounted to the machine for determining a rotational relationship of the superstructure with respect to the traveling device. The positional-relationship sensing system further includes a signaler mounted to the operator station and operatively connected to the system controller for indicating to the operator the forward direction of travel of the machine in accordance with the operator point of view.

In some implementations, the machine has a gearbox, the system controller is operatively connected to the gearbox, and the system controller configures the gearbox according to the rotational relationship of the superstructure with respect to the traveling device.

In some implementations, the machine has a slew system disposed between the traveling device and the superstructure. The slew system is operatively connected to the system controller. The slew system includes a circular race. The superstructure has the beacon. Two sensors are mounted to the circular race. Each sensor defines a sensing region. A line extending between the two sensors defines a diameter of the race. The line is an imaginary line. The line is perpendicular to the forward direction of travel of the machine. The rotation-sensing system sends a signal to the system controller when the beacon enters and exits the sensing region one of the two sensors upon rotation of the superstructure.

In some implementations, the machine has a slew system disposed between the traveling device and the superstructure. The slew system includes a circular race. The superstructure has the beacon. Two pairs of sensors are mounted to the circular race. A line extending between the two pairs of sensors defines a diameter of the race. The line is an imaginary line. The line is perpendicular to the forward direction of travel of the machine. Upon rotation of the superstructure, the rotation-sensing system sends a signal to the system controller when the beacon is rotated past both sensors of either pair of sensors.

In some implementations, the positional-relationship sensing system is selectively deactivatable by the operator.

In some implementations, the signaler emits at least one of an audible indication and a visual indication in the operator station.

In some implementations, the operator station includes at least one camera system mounted to the superstructure for defining the operator point of view. The at least one camera system broadcasts the operator point of view to the operator, and the machine is remotely controlled by the operator.

In some implementations, the machine is an excavator, a crane, a shovel, a backhoe or an articulated boom.

According to another aspect of the present technology, there is provided a method for indicating to an operator a forward direction of travel of a machine. The machine has a ground-engaging traveling device and a superstructure rotatably mounted to the traveling device. The superstructure has an operator station defining an operator point of view. The method involves receiving a rotational relationship of the superstructure with respect to the traveling device, and indicating to the operator the forward travel direction of the machine in accordance with the operator point of view.

In some implementations, the method further includes configuring a gearbox of the machine according to the rotational relationship of the superstructure with respect to the traveling device.

In some implementations, the configuring of the gearbox of the machine involves selecting a gear such that the forward direction of travel of the machine is in accordance with the operator point of view.

In some implementations, the configuring of the gearbox of the machine involves configuring the gearbox into a neutral position.

In some implementations, the indicating is performed by displaying a visual indication in the operator station and/or emitting an audible indication in the operator station.

For purposes of this application, terms related to spatial orientation such as forwardly, rearward, upwardly, downwardly, left, and right, are as they would normally be understood by an operator of the machine sitting in the operator station in a normal operating position. Terms related to spatial orientation when describing or referring to components or sub-assemblies of the machine, separately from the machine, such as a superstructure or travelling device for example, should be understood as they would be understood when these components or sub-assemblies are mounted to the machine, unless specified otherwise in this application.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

With reference to the accompanying Figures, the present detailed description is intended to be a description of a system, more particularly a positional-relationship sensing system, for indicating to an operator a forward direction of travel of a machine in accordance with an implementation of the present technology.

Figure 1:
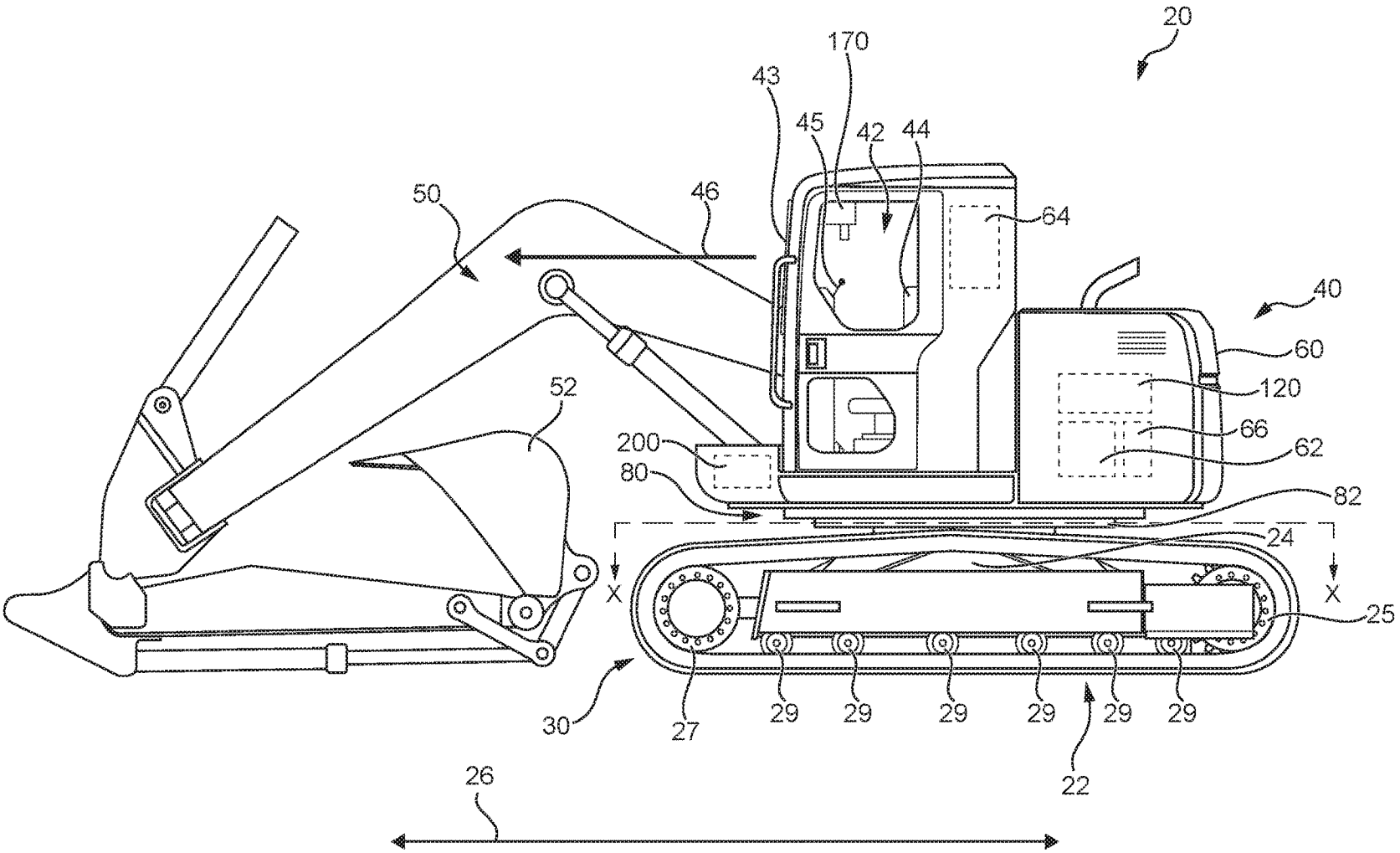
FIG. 1 is a left side elevation view of an excavator having a traveling device and a superstructure rotatably mounted to the traveling device.
Figure 2A:
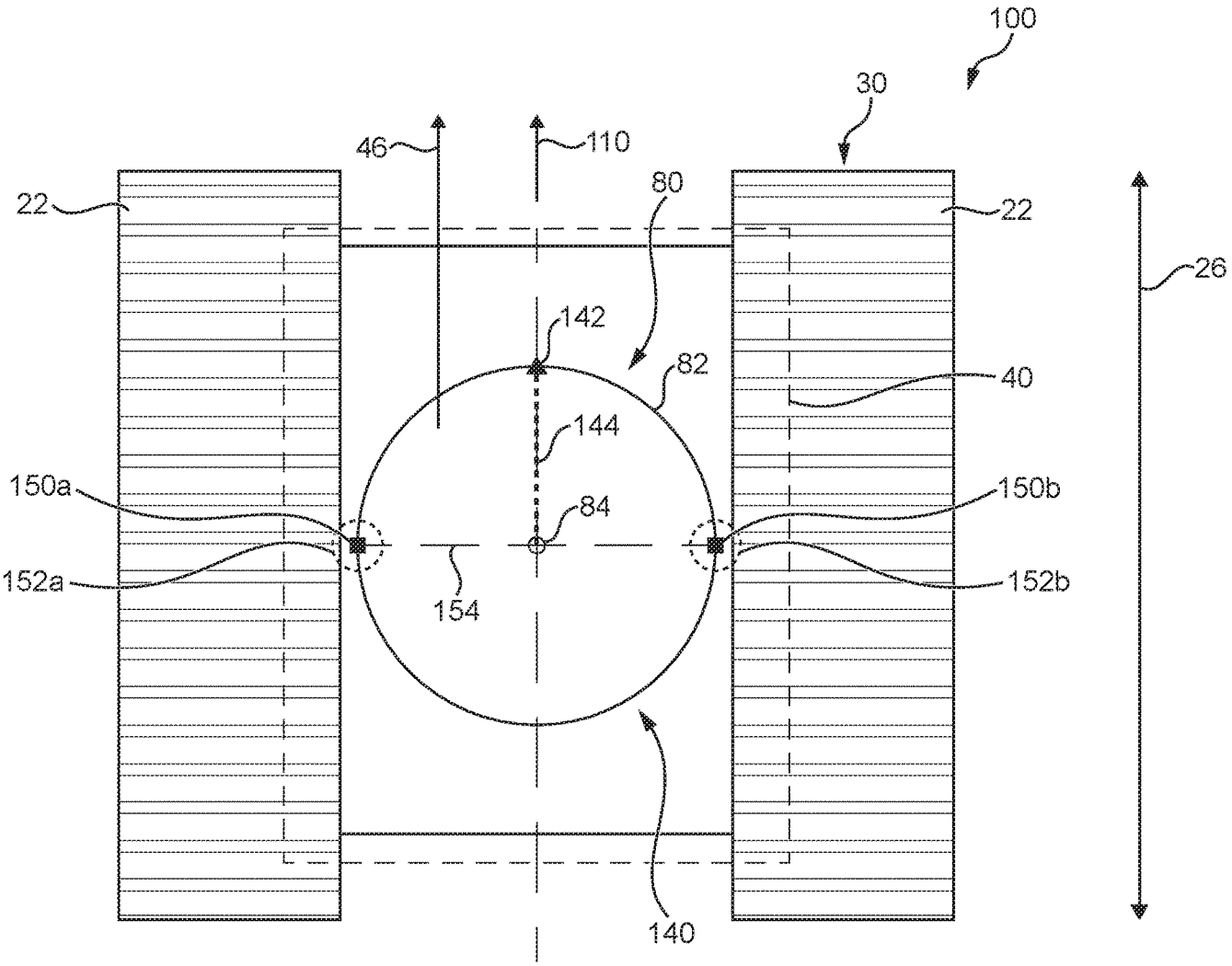
FIG. 2A is a schematic cross-sectional view of the excavator of FIG. 1 taken along cross-section line X-X, with a first implementation of a rotation-sensing system and the superstructure represented with phantom lines.

Referring to FIGS. 1 and 2A, a machine 20 will be generally described. For illustrative purposes, the machine 20 is an excavator, but the machine could be, for example, a crane, a shovel, a backhoe or an articulated boom. The machine 20 has endless tracks 22 as ground-engaging members. The endless tracks 22 are operatively connected to an undercarriage 24 of the machine 20. Sprocket wheels 25 are rotatably mounted to the rear end of the undercarriage 24, idler wheels 27 are rotatably mounted to the front end of the undercarriage 24, and roller wheels 29 are rotatably mounted therebetween. The endless tracks 22 are disposed around the sprocket wheels 25, idler wheels 27 and roller wheels 29. In some implementations, other ground-engaging members could be used. For example, the endless tracks 22 could be replaced by wheels and/or a combination of wheels and endless tracks. The endless tracks 22 define a direction of travel 26 of the machine 20. The direction of travel 26 is parallel to the endless tracks 22. The endless tracks 22 can make the machine 20 go forward or backward along the direction of travel 26, as indicated by the two ends of the arrow representing the direction of travel 26 in FIGS. 1 and 2A. Each one of the endless tracks 22 can be selectively driven forward or backward, enabling the machine 20 to steer left and right. The endless tracks 22 and the undercarriage 24 of the machine 20 define a ground-engaging traveling device 30 of the machine 20.

The machine 20 further has a superstructure 40 rotatably mounted to the traveling device 30. The superstructure 40 includes an operator station 42 inside which an operator takes place. The operator station 42 includes windows 43, a seat 44 and different controllers 45 permitting the operator to drive and operate the machine 20. The operator station 42 defines an operator point of view 46 (schematically shown by an arrow) as the operator operates the machine 20 from inside the operator station 42, sat on the seat 44 and looking forward. The superstructure 40 further includes an articulated arm 50 mounted to the right side of the operator station 42, and an engine compartment 60 mounted at the rear of the operator station 42. A work implement 52 is mounted to an end of the articulated arm 50. In the present implementation, the work implement 52 is a bucket, but the work implement 52 could differ depending on the task the machine 20 is performing. The engine compartment 60 houses several components of the machine 20, such as an engine (not shown), a counterweight (not shown), a gearbox 62, an electrical system 64, and a hydraulic system 66 schematically shown in FIG. 1. At least some of these components are operatively connected to the controllers 45 inside the operator station 42 for operation of the machine 20.

A slew system 80 is disposed between the traveling device 30 and the superstructure 40. The slew system 80 comprises a circular race 82 coupling the superstructure 40 to the traveling device 30. The slew system 80 allows for rotation of the superstructure 40 with respect to the traveling device 30 (or vice-versa) about a rotation center 84 (FIG. 2A). The slew system 80 allows the superstructure 40 to slew 360 degrees unhindered with respect to the traveling device 30 in both clockwise and counter-clockwise directions when seen from above.

Since the operator station 42 is mounted to the superstructure 40, the operator station 42 rotates with respect to the traveling device 30 when slewed. Thus, the operator point of view 46 follows the articulated arm 50 and the work implement 52, and accordingly, the orientation of the operator point of view 46 with respect to the traveling device 30 can be changed upon rotation of the superstructure 40.

Figure 2B:
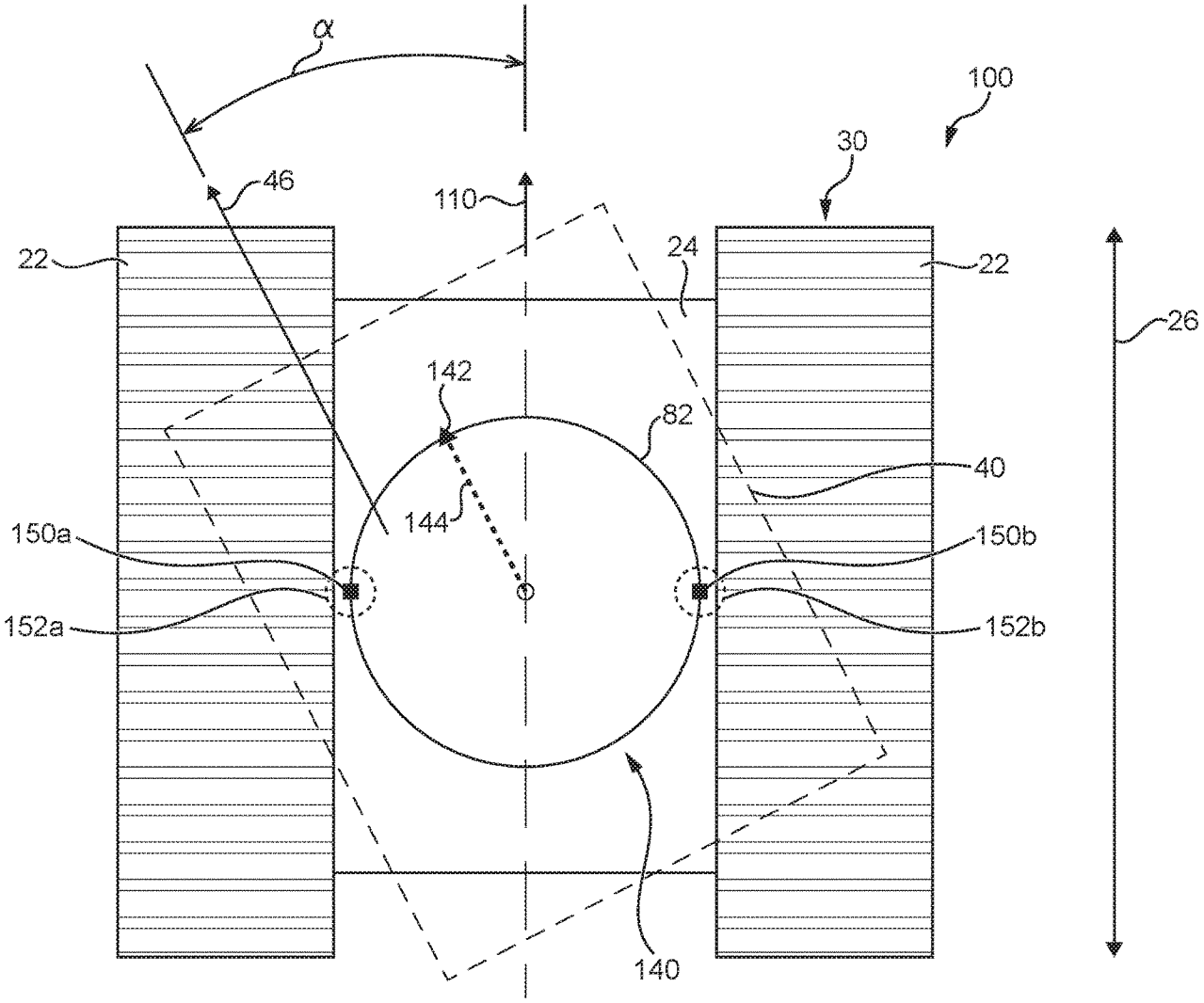
FIG. 2B is a schematic cross-sectional view of the excavator of FIG. 2A, with the superstructure rotated with respect to the traveling device about an angle α.
Figure 2C:
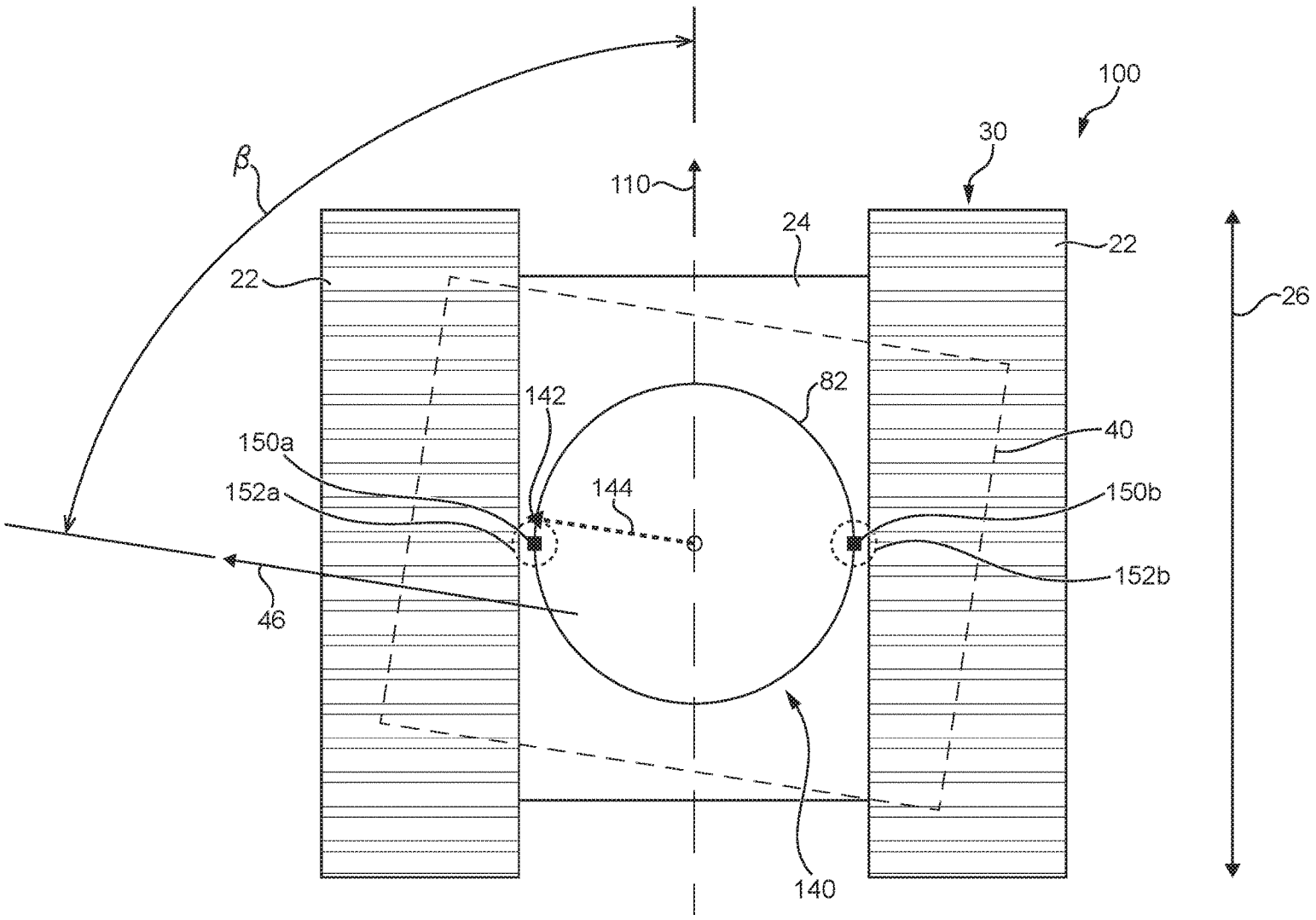
FIG. 2C is a schematic cross-sectional view of the excavator of FIG. 2A, with the superstructure rotated with respect to the traveling device about an angle β.

Referring to FIGS. 1 to 2C, a positional-relationship sensing system 100 (hereinafter referred to as "P.R.S. system") for indicating to the operator a forward direction of travel 110 of the machine 20 will be described. The forward travel direction 110 of the machine 20 is understood to be determined based on the travel direction 26 of the machine 20 and the selected gear of the gearbox 62. The P.R.S. system 100 includes a system controller 120 schematically shown in FIG. 1 that is operatively connected to the electrical system 64 and/or the hydraulic system 66 of the machine 20. The system controller 120 is powered by the electrical system 64, or could be powered by any other suitable energy source. The system controller 120 includes a general purpose computer capable of receiving and sending signals that will be described further below, and is capable of running software programs that perform operations based on the received and sent signals. In some implementations, the system controller 120 is part of the electrical system 64 of the machine 20. In some implementations, the electrical system 64 monitors various parameters of the machine 20 and/or transmits input commands from the controllers 45 to the various components of the machine 20 for operation thereof. As will be described below, the system controller 120 is optionally operatively connected to the slew system 80.

The P.R.S. system 100 further includes a rotation-sensing system 140 operatively connected to the system controller 120. The rotation-sensing system 140 includes at least one sensor mounted to the machine 20 for determining a rotational relationship of the superstructure 40 with respect to the traveling device 30.

The P.R.S. system 100 further includes a signaler 170 (FIG. 1) mounted to the operator station 42. The signaler 170 is operatively connected to the system controller 120 for indicating to the operator the forward direction of travel 110 of the machine 20 in accordance with the operator point of view 46. In some implementations, the signaler 170 is a light mounted to the operator station 42. The signaler 170 could also be a visual indication displayed on a dashboard, on a control screen or a monitor mounted to the operator station 42. In yet some other implementations, the signaler 170 could be a sound emitting device mounted to the operator station 42 emitting audible indications or alerts inside the operator station 42.

There exist various systems and methods for determining the rotational relationship of the superstructure 40 with respect to the traveling device 30. Two illustrative implementations of rotation-sensing systems 140, 240 for determining such rotational relationship are described below with reference to FIGS. 2A to 3D.

Referring to FIGS. 2A to 2D, the rotation-sensing system 140 will be described. The rotation-sensing system 140 includes a beacon 142 that is mounted to the superstructure 40 in the vicinity of the circular race 82 of the slew system 80. The beacon 142 is schematically represented by a triangle in the accompanying Figures. In some implementations, the beacon 142 is operatively connected to the electrical system 64 of the machine 20. An imaginary line 144 extending between the rotation center 84 and the beacon 142 is parallel to the operator point of view 46, and thus to the articulated arm 50. It is to be understood that the beacon 142 could be mounted otherwise to the superstructure 40 without departing from the present technology.

The rotation-sensing system 140 is activated and calibrated when the imaginary line 144 is parallel to the direction of travel 26 of the machine 20, and when the gearbox 62 has a gear selected for moving the machine 20 forward, i.e., when the operator point of view 46 is parallel to the forward direction of travel 110, as seen in FIG. 2A. Sensors 150*a*, 150*b* are mounted to the undercarriage 24 adjacent to the circular race 82. Sensors 150*a*, 150*b* are schematically represented by squares in the accompanying Figures. Each one of the sensors 150*a*, 150*b* defines a respective sensing region 152*a*, 152*b*. The sensing regions 152*a*, 152*b* are schematically shown in FIGS. 2A to 2D and are not to scale. An imaginary line 154 extending between the two sensors 150*a*, 150*b* defines a diameter of the circular race 82. The imaginary line 154 is perpendicular to the forward direction of travel 110 of the machine 20. The sensors 150*a*, 150*b* detect the presence of the beacon 142 when the beacon 142 is located within their respective sensing regions 152*a*, 152*b*.

Figure 2D:
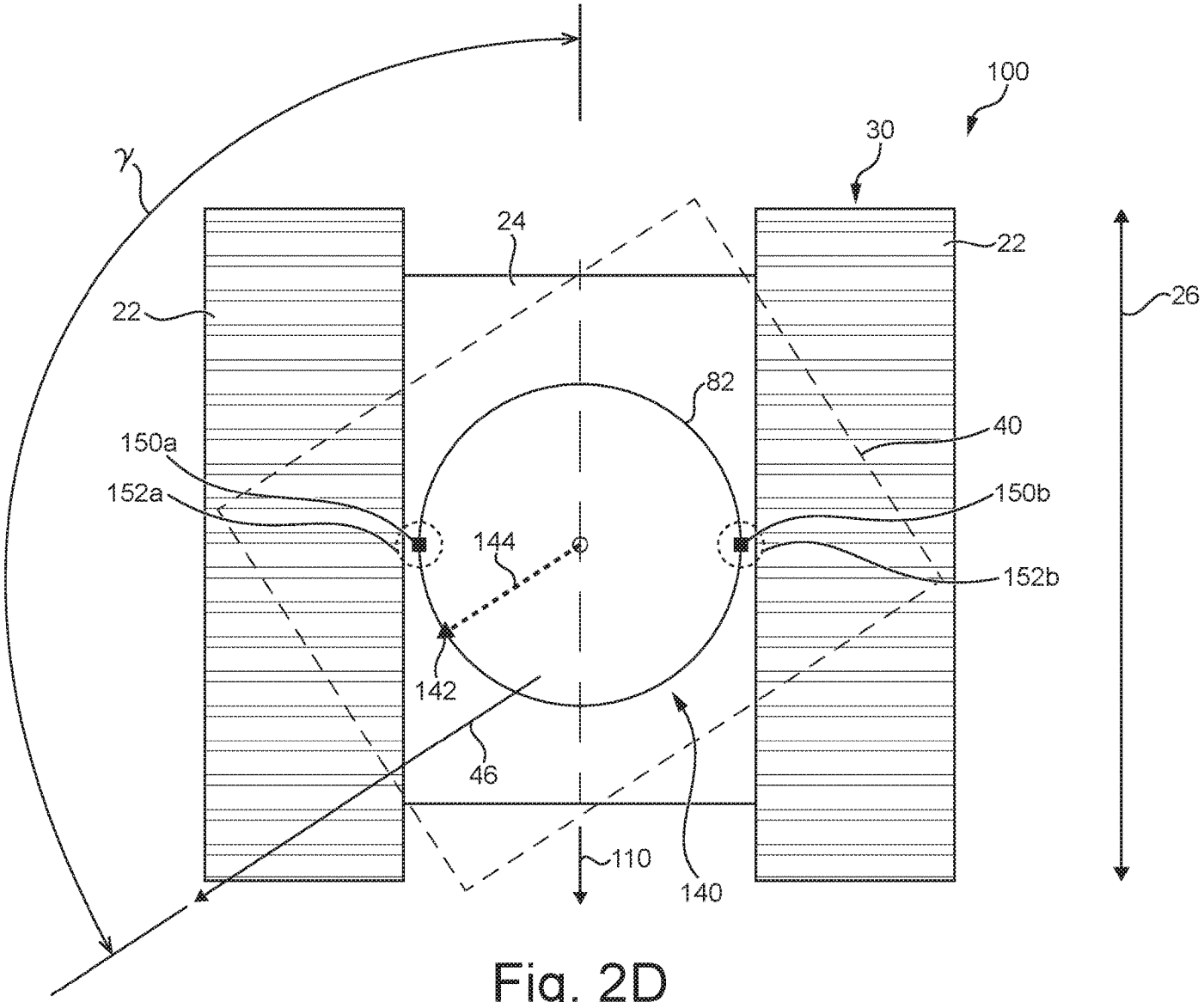
FIG. 2D is a schematic cross-sectional view of the excavator of FIG. 2A, with the superstructure rotated with respect to the traveling device about an angle γ.

Referring to FIGS. 2B to 2D, an illustrative scenario of the use of the P.R.S. system 100 will be described. Referring to FIG. 2B, initially, the gearbox 62 has a forward-moving gear selected and the superstructure 40 is rotated counter-clockwise with respect to the traveling device 30 by an angle $\alpha$. Thus, the operator point of view 46 and the forward travel direction 110 of the machine 20 are angularly displaced by the same angle $\alpha$. If the operator operates the machine 20 to move forward, the machine 20 will be moved along the forward direction of travel 110. The forward direction of travel 110 is intuitive for the operator as it is directed generally in front of the operator point of view 46. Furthermore and referring to FIG. 4A, the system controller 120 is operatively connected to the slew system 80 for monitoring the direction of rotation of the slew system 80.

Referring back to FIG. 2C, the superstructure 40 is further rotated counter-clockwise with respect to the traveling device 30 to an angle $\beta$ as the operator operates the slew system 80. The beacon 142 enters within the sensing region 152*a*. Simultaneously, the sensor 150*a* detects the beacon 142 and sends a first sensor-to-system controller signal to the system controller 120. In some implementations, when the system controller 120 receives the first sensor-to-system controller signal, the system controller 120 sends a first system controller-to-signaler signal to the signaler 170 for warning the operator that the superstructure 40 is about to be rotated past the sensor 150*a*.

Referring to FIG. 2D, when the superstructure 40 is rotated counter-clockwise even further with respect to the traveling device 30 to an angle $\gamma$ as the operator operates the slew system 80, the beacon 142 exits the sensing region 152*a*. Simultaneously, the sensor 150*a* loses detection of the beacon 142, and sends a second sensor-to-system controller signal to the system controller 120. The system controller 120 uses the information of the received first and second sensor-to-system controller signals and of the direction of rotation of the slew system 80 for determining that the superstructure 40 has been rotated past the sensor 150*a*. The system controller 120 then sends a second system controller-to-signaler signal to the signaler 170 mounted to the operator station 42. The signaler 170 turns on and indicates to the operator that the forward direction of travel 110 is positioned generally opposite to the operator point of view 46. As a result, the operator can select a gear of the gearbox 62 for moving the machine 20 rearward, thus inversing the forward direction of travel 110 of the machine to a more intuitive direction according to the operator point of view 46 to facilitate operation of the machine 20, as shown by the arrow 110 in FIG. 2D. In some implementations, the P.R.S. system 100 is operatively connected to the gearbox 62, as shown by the dashed line in FIGS. 4A and 4B. In such implementations, simultaneously the signaler 170 is turned on, the system controller 120 sends a signal to the gearbox 62 for disengaging the selected gear and revert to the neutral position. This way, the operator cannot inadvertently move the machine 20 along the direction of travel 26 of the machine 20, either backward or forward, without knowingly selecting a gear of the gearbox 62.

Figure 3A:
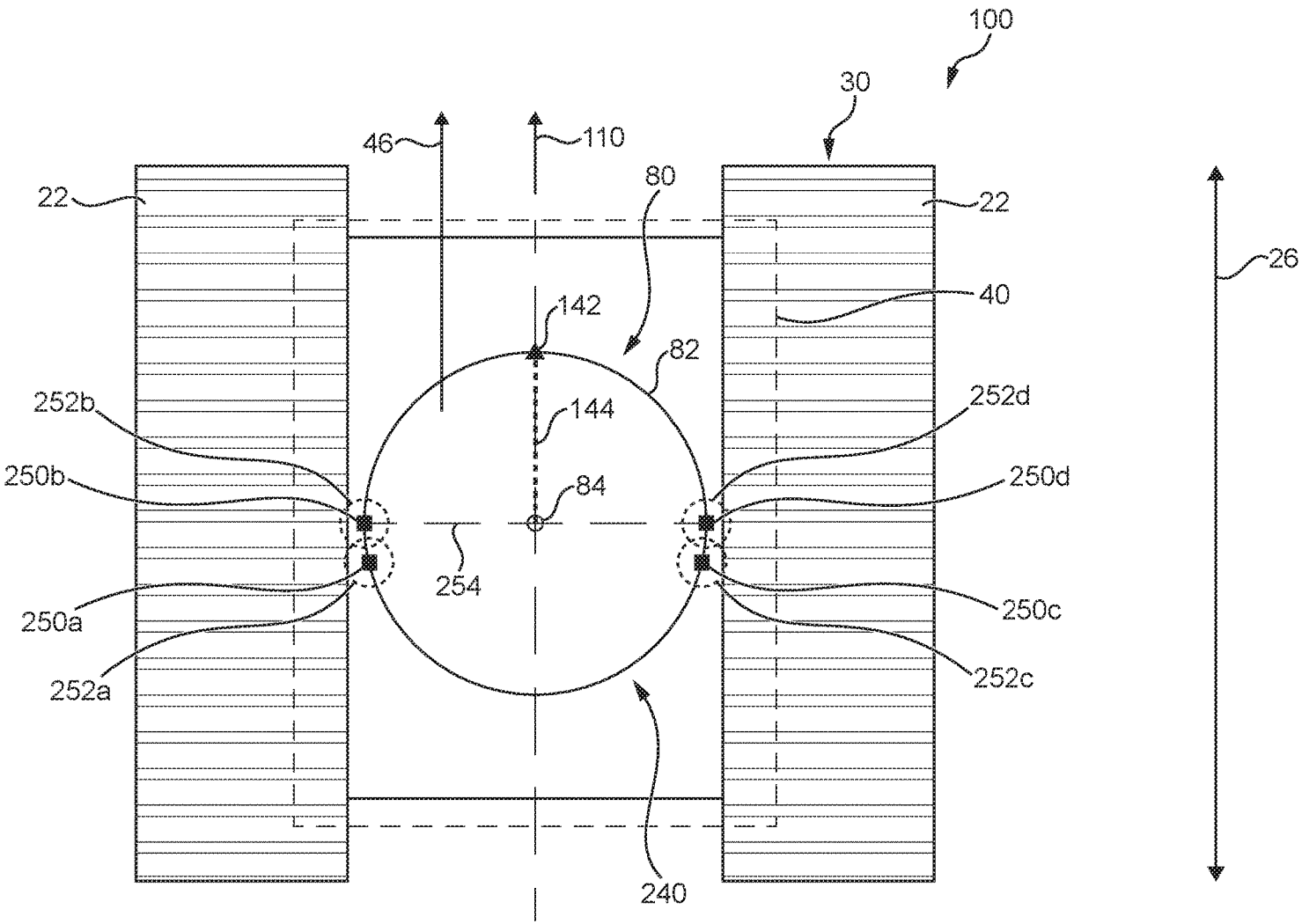
FIG. 3A is a schematic cross-sectional view of the excavator of FIG. 1 taken along cross-section line X-X, with a second implementation of a rotation-sensing system and the superstructure represented with phantom lines.

Referring to FIGS. 3A to 3D, the rotation-sensing system 240 will be described. The rotation-sensing system 240 has components similar to the ones described above with respect to the rotation-sensing system 140 and they perform substantially similar functions, unless mentioned otherwise. Similar to the rotation-sensing system 140, the rotation-sensing system 240 is activated and calibrated when the imaginary line 144 is parallel to the direction of travel 26 of the machine 20, and when the gearbox 62 has a gear selected for moving the machine 20 forward, i.e. in the forward direction of travel 110, as seen in FIG. 3A. The rotation-sensing system 240 includes four sensors 250*a*, 250*b*, 250*c*, 250*d* that are mounted to the undercarriage 24 in the vicinity of the circular race 82. The sensors 250*a*, 250*b* are mounted as a pair of sensors and are positioned adjacent to each other, and the sensors 250*c*, 250*d* are also mounted as a pair of sensors and are positioned adjacent to each other. An imaginary line 254 extending between the two sensors 250*a*, 250*c* defines a diameter of the circular race 82. The imaginary line 254 is perpendicular to the forward direction of travel 110 of the machine 20. In some implementations, the pairs of sensors 250*a*, 250*b*, 250*c*, 250*d* could be mounted otherwise to the undercarriage 24. Each one of the sensors 250*a*, 250*b*, 250*c*, 250*d* defines a respective sensing region 252*a*, 252*b*, 252*c*, 252*d*. The sensing regions 252*a*, 252*b*, 252*c*, 252*d* are schematically shown in FIGS. 3A to 3D and are not to scale. The sensing regions 252*a*, 252*b* overlap, and the sensing regions 252*c*, 252*d* overlap. The sensors 250*a*, 250*b*, 250*c*, 250*d* detect the presence of the beacon 142 when the beacon 142 is located within the sensing regions 252*a*, 252*b*, 252*c*, 252*d*.

Figure 3B:
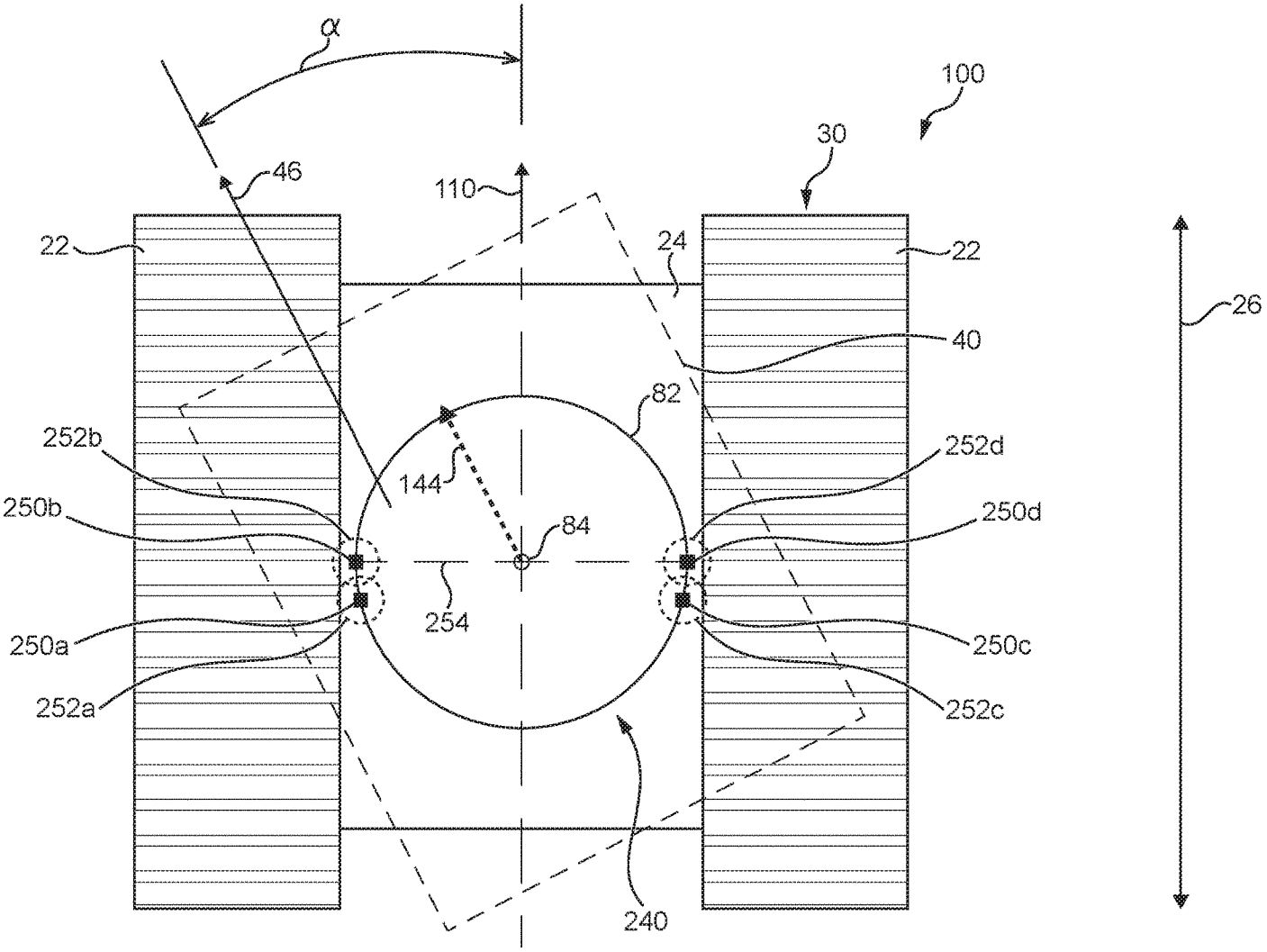
FIG. 3B is a schematic cross-sectional view of the excavator of FIG. 3A, with the superstructure rotated with respect to the traveling device about an angle α.

The operation of the rotation-sensing system 240 will now be described. Referring to FIG. 3B, initially, the gearbox 62 has a forward-moving gear selected and the superstructure 40 is rotated counter-clockwise with respect to the traveling device 30 by an angle α. Thus, the operator point of view 46 and the forward travel direction 110 of the machine 20 are angularly displaced by the same angle α. Again, the forward direction of travel 110 is intuitive for the operator as it is directed generally in front of the operator point of view 46.

Figure 3C:
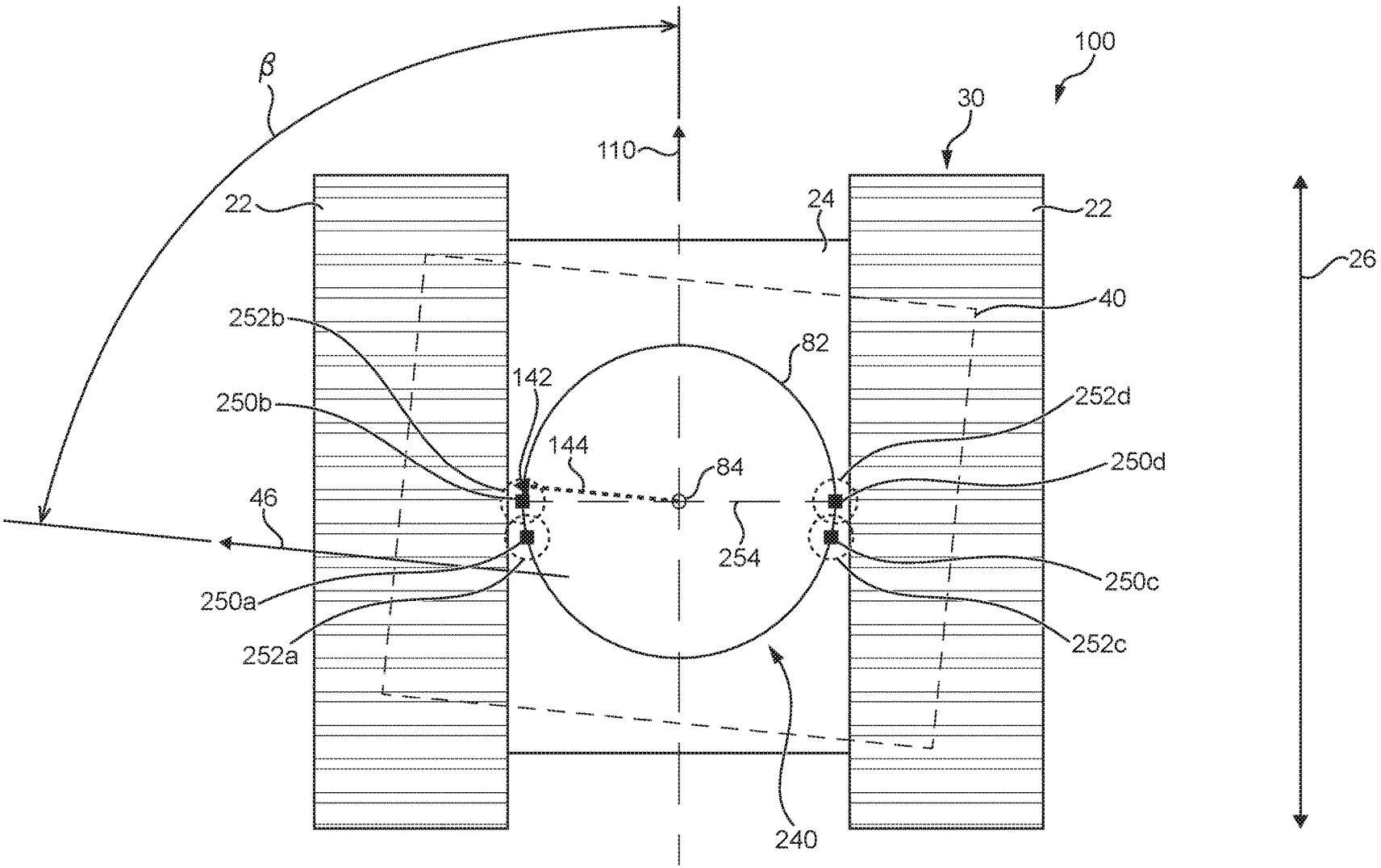
FIG. 3C is a schematic cross-sectional view of the excavator of FIG. 3A, with the superstructure rotated with respect to the traveling device about an angle β.

Referring to FIG. 3C, the superstructure 40 is further rotated counter-clockwise with respect to the traveling device 30 to the angle β as the operator operates the slew system 80. The beacon 142 enters within the sensing region 252*b*. Simultaneously, the sensor 250*b* detects the beacon 142 and sends a first sensor-to-system controller signal to the system controller 120.

Figure 3D:
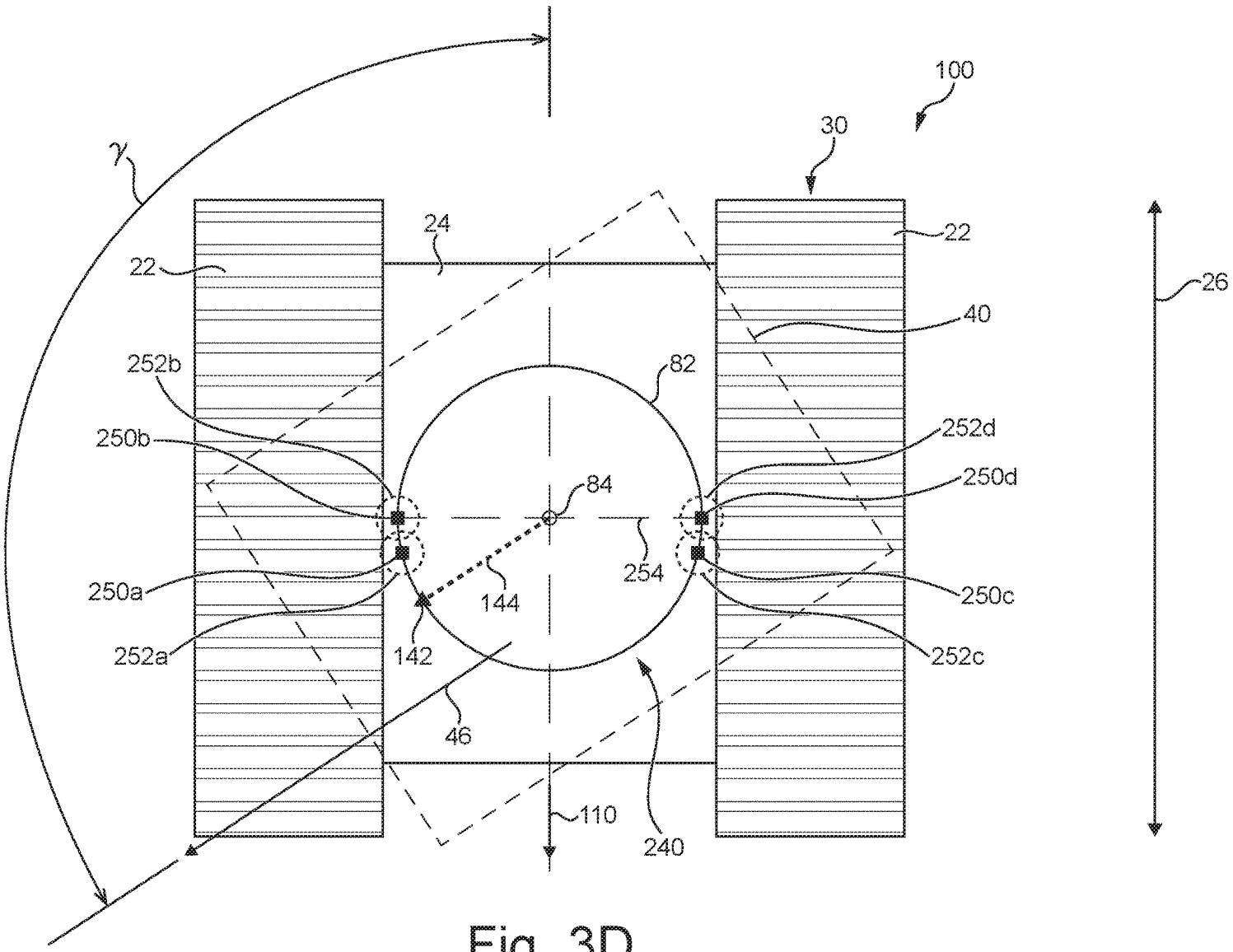
FIG. 3D is a schematic cross-sectional view of the excavator of FIG. 3A, with the superstructure rotated with respect to the traveling device about an angle γ.

Referring now to FIG. 3D, when the superstructure 40 is rotated counter-clockwise even further with respect to the traveling device 30 up to the angle γ as the operator operates the slew system 80, the beacon 142 enters the sensing region 252*a*, and the sensor 250*a* sends a second sensor-to-system controller signal to the system controller 120. The beacon 142 is thus momentarily detected by both sensors 250*a*, 250*b* as the beacon 142 is located within the overlapping regions of the sensing regions 252*a*, 252*b*. When the superstructure 40 is further rotated counter-clockwise, the beacon 142 exits the sensing region 252*b* and when the sensor 250*b* loses detection of the beacon 142, the sensor 250*b* sends a third sensor-to-system controller signal to the system controller 120. When the superstructure 40 is rotated counter-clockwise even further to reach the angle γ shown in FIG. 3D, the sensor 250*a* loses detection of the beacon 142 and sends a fourth sensor-to-system controller signal to the system controller 120. The system controller 120 uses the information of the first, second, third and fourth sensor-to-system controller signals for determining that the superstructure 40 has been rotated past the sensors 250*a*, 250*b*. The system controller 120 sends a first system controller-to-signaler signal to the signaler 170 mounted to the operator station 42. The signaler 170 turns on and indicates to the operator that the forward direction of travel 110 is directed generally opposite to the operator point of view 46. When the signaler 170 is turned on, a visual and/or an audible indication are directed to the operator. As a result, the operator can select a gear of the gearbox 62 for moving the machine 20 rearward, thus inversing the forward direction of travel 110 of the machine to a more intuitive direction according to the operator point of view 46 to facilitate operation of the machine 20, as shown by the arrow 110 in FIG. 3D. In some implementations, the P.R.S. system 100 is operatively connected to the gearbox 62, as shown by the dashed line in FIGS. 4A and 4B. In such implementations, simultaneously the signaler 170 is turned on, the system controller 120 sends a signal to the gearbox 62 for disengaging the selected gear and revert to the neutral position. This way, the operator cannot inadvertently move the machine 20 along the direction of travel 26 of the machine 20, either backward or forward, without knowingly selecting a gear of the gearbox 62.

Figure 4A:
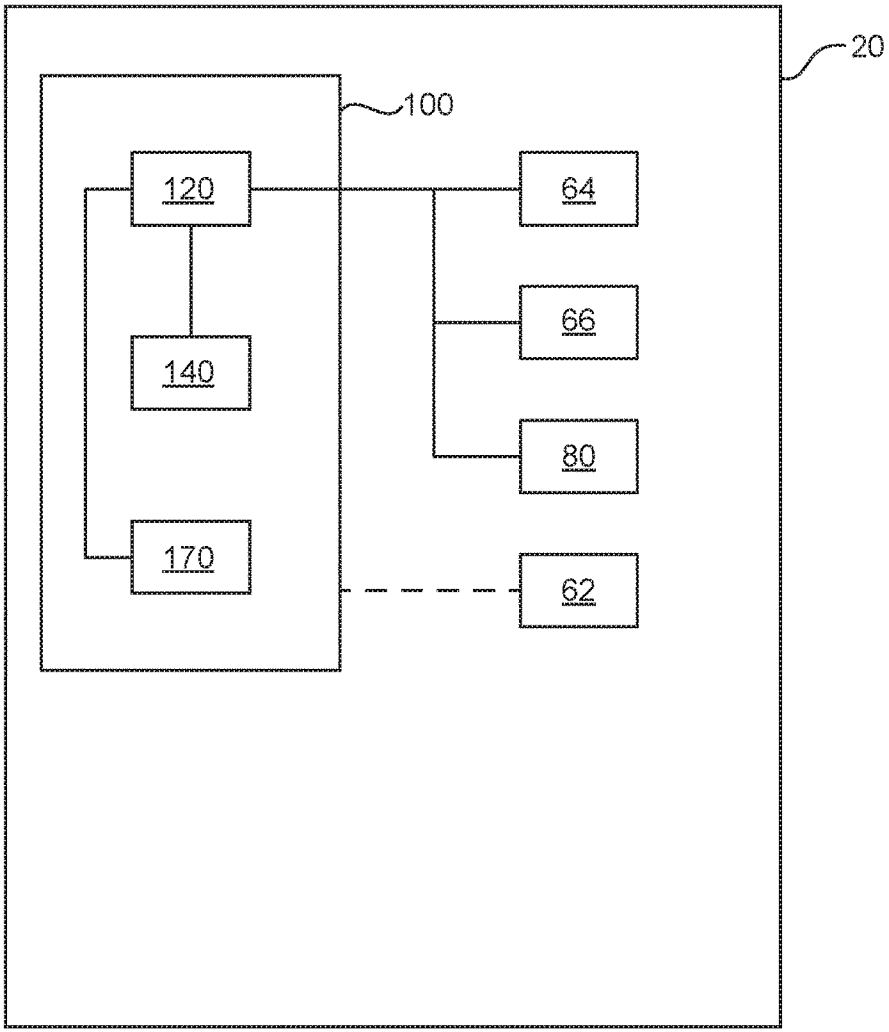
FIG. 4A is a schematic view of the machine of FIG. 1, with a positional-relationship sensing system in accordance with a first implementation of the present technology.
Figure 4B:
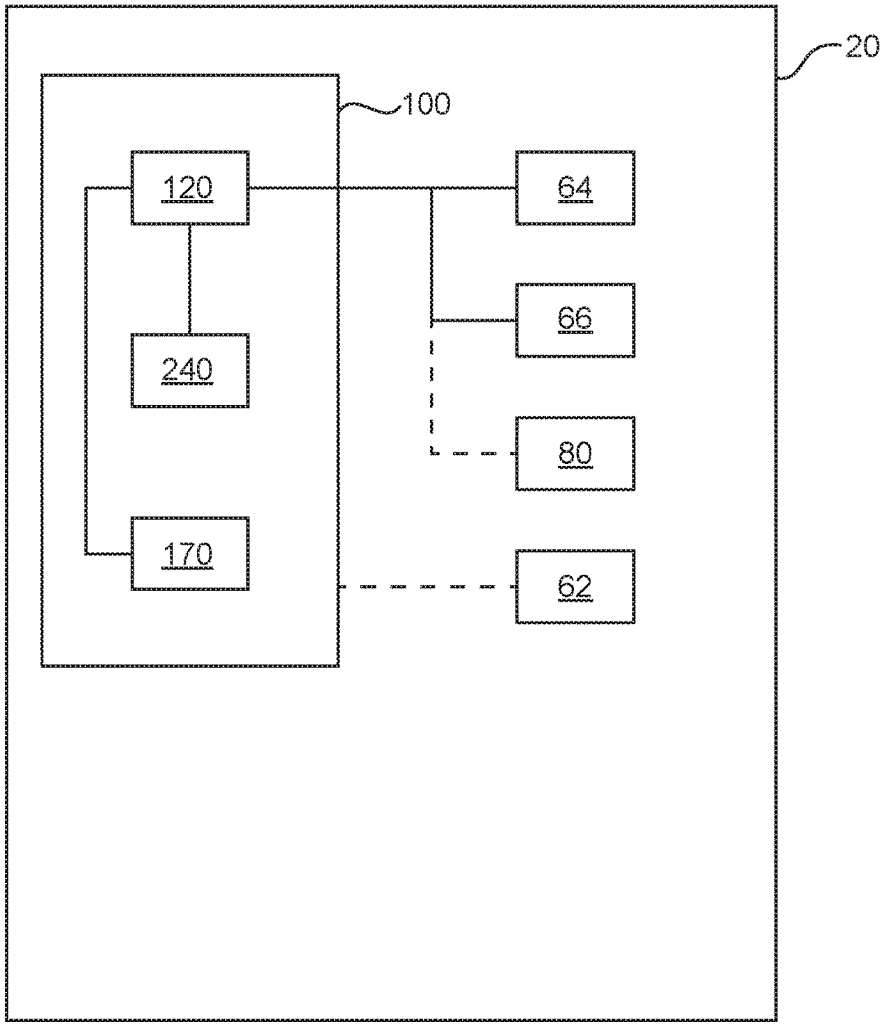
FIG. 4B is a schematic view of the machine of FIG. 1, with a positional-relationship sensing system in accordance with a second implementation of the present technology.

The rotation-sensing system 240 presents the advantage of not necessarily requiring the operative connection between the system controller 120 and the slew system 80 for monitoring the direction of rotation thereof, as indicated by the dashed line in FIG. 4B. This implementation may be suited for certain types of machines 20 that do not permit such operative connection and/or can allow the P.R.S. system 100 to be retrofitted on different types of machines 20.

In both the above-described implementations of the rotation-sensing system 140, 240, when the superstructure 40 is rotated clockwise from the angle γ and the beacon 142 is moved past the sensor 150*a*, or the pairs of sensors 250*a*, 250*b*, it is understood that the P.R.S. system 100 functions as described above, but in reverse. As such, when the beacon 142 is moved past the sensor 150*a*, or the pairs of sensors 250*a*, 250*b*, the signaler 170 turns on and indicates to the operator that the forward direction of travel 110 is directed generally opposite to the operator point of view 46. The operator can select a gear of the gearbox 62 for moving the machine 20 forward, thus restoring the forward direction of travel 110 as the one shown in FIGS. 2A to 2C, and 3A to 3C.

In addition, it is to be understood that in the event the superstructure 40 would be rotated clockwise from the position shown in FIG. 2A and the beacon 142 is moved past the sensor 150*b*, or the pairs of sensors 250*c*, 250*d*, up to a similar angle γ, the P.R.S. system 100 would function as described above. As such, when the beacon 142 is moved past the sensor 150*b*, or the pairs of sensors 250*c*, 250*d*, the signaler 170 would turn on and indicate to the operator that the forward direction of travel 110 is directed generally opposite to the operator point of view 46.

In some implementations, the P.R.S. system 100 can be deactivated by the operator. It is contemplated that a button mounted in the operator station 42 can be pressed by the operator to selectively turn off the P.R.S. system 100.

In some implementations, the P.R.S. system 100 is operatively connected to the gearbox 62, as shown by the dashed line in FIGS. 4A and 4B. In such an implementation, it is contemplated that when the signaler 170 is turned on and after the operator has selected a gear of the gearbox 62 to move the machine 20 forwardly in accordance with the operator point of view 46, the system controller 120 sends another system controller-to-signaler signal to the signaler 170 to turn it off, such that the signaler 170 is then ready to be turned on once again when the forward direction of travel 110 would be directed generally opposite to the operator point of view 46. In another implementation, when the system controller 120 sends a system controller-to-signaler signal to the signaler 170 to indicate to the operator that the forward direction of travel 110 is positioned generally opposite to the operator point of view 46, the system controller 120 could simultaneously send a system controller-to-gearbox signal to the gearbox 62 to operate a gear change for making the machine 20 move in the opposite travel direction 26. The signaler 170 could then indicate to the operator that the forward direction of travel 110 is generally in front of the operator point of view 46 and that the gearbox 62 has been configured to move the machine 20 forward in accordance with the operator point of view 46. This implementation could thus enable automatic changes of gear of the gearbox 62 based on the operator point of view 46 in order to facilitate operation of the machine 20 under certain circumstances.

In yet another implementation, the operator station 42 includes a camera system (not shown) mounted to the superstructure 40. The camera system could define the operator point of view 44. The camera system could broadcast the operator point of view 44 to a monitor. The monitor and the operator could be located inside the operator station 42 or, in some circumstances, outside of the operator station 42. It is contemplated that the operator could be remotely controlling the machine 20 using the monitor and a remote controller. It is contemplated that the P.R.S. system 100 could display an indication on the monitor displaying the images received from the camera system to the operator for indicating to the operator the forward direction of travel 110 of the machine 20 in accordance with the operator point of view 44.

In accordance with another aspect of the present technology, there will be described a method 300 for indicating to the operator the forward direction of travel 110 of the machine 20. The method 300 involves receiving a rotational relationship of the superstructure 40 with respect to the traveling device 30 (310). The rotational relationship can be determined using any one of the rotation-sensing systems 140, 240 described above, or using any other systems and methods known in the art such as, but not limited to, those described in U.S. Pat. No. 8,836,323 B2, JP H0674751 A, JP 2008214997 A, and U.S. Pat. No. 7,746,067 B2. All documents referred to herein are incorporated by reference. In some machines, a main control unit 200 (schematically shown in FIG. 1) determines the rotational relationship of the superstructure 40 with respect to the traveling device 30, and the main control unit 200 is operatively connected to other systems of the machine 20 for monitoring or operating the various components of the machine 20. As such, the P.R.S. system 100 described above could be operatively connected to the main control unit 200 to receive the rotational relationship of the superstructure 40 with respect to the traveling device 30, making the rotation-sensing systems 140, 240 optional for performing the method 300. Once received, the rotational relationship can be used for indicating to the operator the forward travel direction 110 of the machine 20 in accordance with the operator point of view 46 (320). For example, the indicating step 320 could be performed using the signaler 170 described above.

Figure 5:
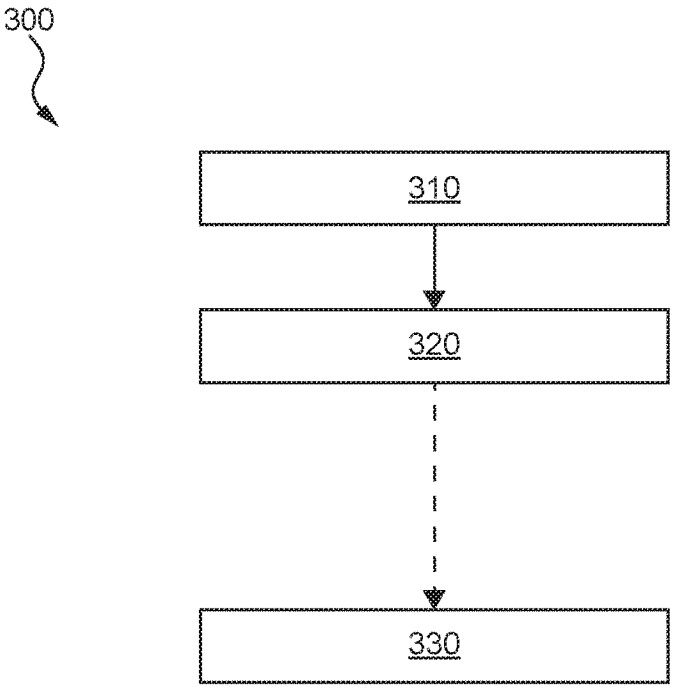
FIG. 5 is a flow diagram of a method for indicating to an operator a forward direction of travel of a machine in accordance with one implementation of the present technology.

In some implementations, the method 300 further involves configuring the gearbox 62 of the machine 20 according to the positional relationship of the superstructure 40 with respect to the traveling device 30 (330), as schematically shown by the dashed line in FIG. 5. Such configuring 330 of the gearbox 62 could facilitate the operation of the machine 20 to the operator under certain circumstances, as described above. Such configuring 330 of the gearbox 62 could also result in the gearbox 62 being reverted to the neutral position, necessitating the operator to select a gear to move the machine 20 along the direction of travel 26, either forward or backward.

Modifications and improvements to the above-described implementation of the present technology may become apparent to those skilled in the art. The foregoing description is intended to be exemplary rather than limiting. The scope of the present technology is therefore intended to be limited solely by the scope of the appended claims.

The invention claimed is:

1. A positional-relationship sensing system for indicating to an operator a forward direction of travel of a machine, the machine having a ground-engaging traveling device, a superstructure rotatably mounted to the traveling device and having an operator station defining an operator point of view, and a slew system disposed between the traveling device and the superstructure, the slew system having a circular race, the positional-relationship sensing system comprising:

a system controller configured to be operatively connected to the slew system;

a rotation-sensing system operatively connected to the system controller, the rotation-sensing system comprising a beacon configured to be mounted to the superstructure and two sensors configured to be mounted to the circular race for determining a rotational relationship of the superstructure with respect to the traveling device, each of the two sensors defining a sensing region, the two sensors being configured to be mounted to the circular race such that an imaginary line extending between the two sensors defines a diameter of the race, the imaginary line being perpendicular to the forward direction of travel of the machine; and a signaler configured to be mounted to the operator station and operatively connected to the system controller for indicating to the operator the forward direction of travel of the machine in accordance with the operator point of view, the rotation-sensing system sending a signal to the system controller in response to the beacon entering and exiting the sensing region of one of the two sensors upon rotation of the superstructure.

2. The positional-relationship sensing system of claim 1, wherein:

the machine comprises a gearbox;

the system controller is configured to be operatively connected to the gearbox; and the system controller configures the gearbox according to the rotational relationship of the superstructure with respect to the traveling device.

3. The positional-relationship sensing system of claim 1, wherein the positional-relationship sensing system is selectively deactivatable by the operator.

4. The positional-relationship sensing system of claim 1, wherein the signaler emits at least one of:

an audible indication in the operator station; and a visual indication in the operator station.

5. The positional-relationship sensing system of claim 1, wherein:

the operator station comprises at least one camera system mounted to the superstructure for defining the operator point of view;

the at least one camera system broadcasts the operator point of view to the operator; and the machine is remotely controlled by the operator.

6. The positional-relationship sensing system of claim 1, wherein the machine is one of an excavator, a crane, a shovel, a backhoe and an articulated boom.

7. A positional-relationship sensing system for indicating to an operator a forward direction of travel of a machine, the machine having a ground-engaging traveling device, a superstructure rotatably mounted to the traveling device and having an operator station defining an operator point of view, and a slew system disposed between the traveling device and the superstructure, the slew system having a circular race, the positional-relationship sensing system comprising:

a system controller configured to be operatively connected to the machine;

a rotation-sensing system operatively connected to the system controller comprising a beacon configured to be mounted to the superstructure and two pairs of sensors configured to be mounted to the circular race for determining a rotational relationship of the superstructure with respect to the traveling device; and the two pairs of sensors being configured to be mounted to the circular race such that an imaginary line extending between the two pairs of sensors defines a diameter of the race, the imaginary line being perpendicular to the forward direction of travel of the machine; and a signaler configured to be mounted to the operator station and operatively connected to the system controller for indicating to the operator the forward direction of travel of the machine in accordance with the operator point of view, upon rotation of the superstructure, the rotation-sensing system being configured to send a signal to the system controller in response to the beacon being rotated past both sensors of either pair of sensors.

8. The positional-relationship sensing system of claim 7, wherein:

the machine comprises a gearbox;

the system controller is configured to be operatively connected to the gearbox; and the system controller configures the gearbox according to the rotational relationship of the superstructure with respect to the traveling device.

9. The positional-relationship sensing system of claim 7, wherein the positional-relationship sensing system is selectively deactivatable by the operator.

10. The positional-relationship sensing system of claim 7, wherein the signaler emits at least one of:

an audible indication in the operator station; and a visual indication in the operator station.

11. The positional-relationship sensing system of claim 7, wherein:

the operator station comprises at least one camera system mounted to the superstructure for defining the operator point of view;

the at least one camera system broadcasts the operator point of view to the operator; and the machine is remotely controlled by the operator.

12. The positional-relationship sensing system of claim 7, wherein the machine is one of an excavator, a crane, a shovel, a backhoe and an articulated boom.

13. A machine comprising:

a ground-engaging traveling device;

a superstructure rotatably mounted to the traveling device and having an operator station defining an operator point of view;

a slew system disposed between the traveling device and the superstructure, the slew system having a circular race; and a positional-relationship sensing system for indicating to an operator a forward direction of travel of the machine, the positional-relationship sensing system comprising:

a system controller operatively connected to the slew system;

a rotation-sensing system operatively connected to the system controller, the rotation-sensing system comprising a beacon mounted to the superstructure and two sensors mounted to the circular race for determining a rotational relationship of the superstructure with respect to the traveling device, each of the two sensors defining a sensing region, an imaginary line extending between the two sensors defining a diameter of the race, the imaginary line being perpendicular to the forward direction of travel of the machine; and a signaler mounted to the operator station and operatively connected to the system controller for indicating to the operator the forward direction of travel of the machine in accordance with the operator point of view, the rotation-sensing system sending a signal to the system controller in response to the beacon entering and exiting the sensing region of one of the two sensors upon rotation of the superstructure.

14. The machine of claim 13, further comprising a gearbox; and wherein:

the system controller is operatively connected to the gearbox; and the system controller configures the gearbox according to the rotational relationship of the superstructure with respect to the traveling device.

15. The machine of claim 13, wherein the positional-relationship sensing system is selectively deactivatable by the operator.

16. The machine of claim 13, wherein the signaler emits at least one of:

an audible indication in the operator station; and a visual indication in the operator station.

17. The machine of claim 13, wherein:

the operator station comprises at least one camera system mounted to the superstructure for defining the operator point of view;

the at least one camera system broadcasts the operator point of view to the operator; and the machine is remotely controlled by the operator.

18. The machine of claim 13, wherein the machine is one of an excavator, a crane, a shovel, a backhoe and an articulated boom.

* * * * *